United States Patent [19]

Whitson

[11] Patent Number: 4,766,975

[45] Date of Patent: Aug. 30, 1988

[54] COLLAPSIBLE SCAFFOLDING

[76] Inventor: Frederick A. Whitson, 5433 Provence Pl., Riverside, Calif. 92506

[21] Appl. No.: 96,347

[22] Filed: Sep. 8, 1987

[51] Int. Cl.[4] ..... E04G 3/10

[52] U.S. Cl. ..... 182/150; 182/142; 182/152; 182/222

[58] Field of Search ..... 182/150, 142, 143, 128, 182/82, 222, 152, 46

[56] References Cited

U.S. PATENT DOCUMENTS

| | | | |
|---|---|---|---|
| 3,951,232 | 4/1976 | Okada | 182/142 |
| 4,068,738 | 1/1978 | Reed | 182/150 |
| 4,253,548 | 3/1981 | Beeche | 182/150 |
| 4,253,549 | 3/1981 | Petren | 182/150 |
| 4,496,029 | 1/1985 | Kuroda | 182/222 |

FOREIGN PATENT DOCUMENTS

| | | | |
|---|---|---|---|
| 402625 | 3/1974 | U.S.S.R. | 182/150 |
| 709781 | 1/1980 | U.S.S.R. | 182/150 |

*Primary Examiner*—Reinaldo P. Machado

*Attorney, Agent, or Firm*—McAulay, Fields, Fisher, Goldstein & Nissen

[57] ABSTRACT

The outer support frame of a platform of collapsible scaffolding consists of a box beam surmounted by a kick plate, the upper edge of which locates in a channel in the base of the support frame of the next higher platform.

5 Claims, 4 Drawing Sheets

COLLAPSIBLE SCAFFOLDING

FIELD OF THE INVENTION

This invention relates to scaffolding consisting of a number of platforms which may be suspended in a vertical array by vertically extending chains.

BACKGROUND OF THE INVENTION

Collapsible scaffolding of the type to which the invention relates is disclosed in British patent specification No. 2 151 290A. The corners of a number of platforms are connected at intervals to chains. The platforms may be arranged in a stack with the lowest platform supported on the ground. A winch may be used to raise the remaining platforms into a vertically spaced array. Alternatively, the uppermost platform may be fixed at a position above ground and the remaining platforms lowered to form the array. Guides for the winch cables fixed on each platform interfit as the scaffolding collapses after use and ensure that the platforms form a stack in a controlled fashion. Guard rails extend between the chains. The known scaffolding suffers from a number of disadvantages. Each of the guides consists of a vertical tube with a bell-mouth at its lower end for receiving the upper end of the next lower guide. The guides are subjected to considerable stresses as they begin to interlock. Modern fabrication techniques make it desirable for the framework of each platform to be manufactured from glass reinforced plastics (GRP) and guides of this type are not suited for use with a GRP framework. The guard rails fixed to the chains induce the chains to fall neatly into the interiors of the platform as the scaffolding collapses.

OBJECTS OF THE INVENTION

It is a principal object of the invention to provide an improved guide arrangemnt which suffers minimal stressing as the scaffolding collapses to form a stack.

It is another object of the invention to provide a guide arrangement suitable for use with platforms having metal or GRP frameworks.

It is a further object of the invention to provide collapsible scaffolding with a guide rail arrangement which induces the chains to fall within the platform interiors as the scaffolding collapses.

SUMMARY OF THE INVENTION

In accordance with the invention, at least one of the platforms of collapsible scaffolding has a support framework including an outer frame member consisting of a beam formed with a channel in its underside and provided with an upstanding rib on its upper side, so that the rib interfits with the channel of of the frame of the immediately superposed platform when the scaffolding collapses. It will be understood that the outer frame member of the lowest platform need not be provided with a channel. The rib may form a toe-plate which bounds the platform.

At least one guard rail associated with each side of each platform may be in the form of a tube through which passes a chin or cable, in which is incorporated a tension spring to cause the support chains to be drawn together as the scaffolding collapses and the support chains slacken, with the result that the chains fall into the space defined within the toe-plate.

DESCRIPTION OF THE DRAWINGS

FIGS. 6 and 7 are of a second embodiment.

DESCRIPTION OF PREFERRED EMBODIMENT

The present invention is applicable to scaffolding of the type disclosed in British patent specification No. 2 151 290A, the disclosure of which is incorporated herein by reference. The construction and operation of the scaffolding will not, therefore, be described in detail, except to the extent necessary to explain the invention.

Figure 1:
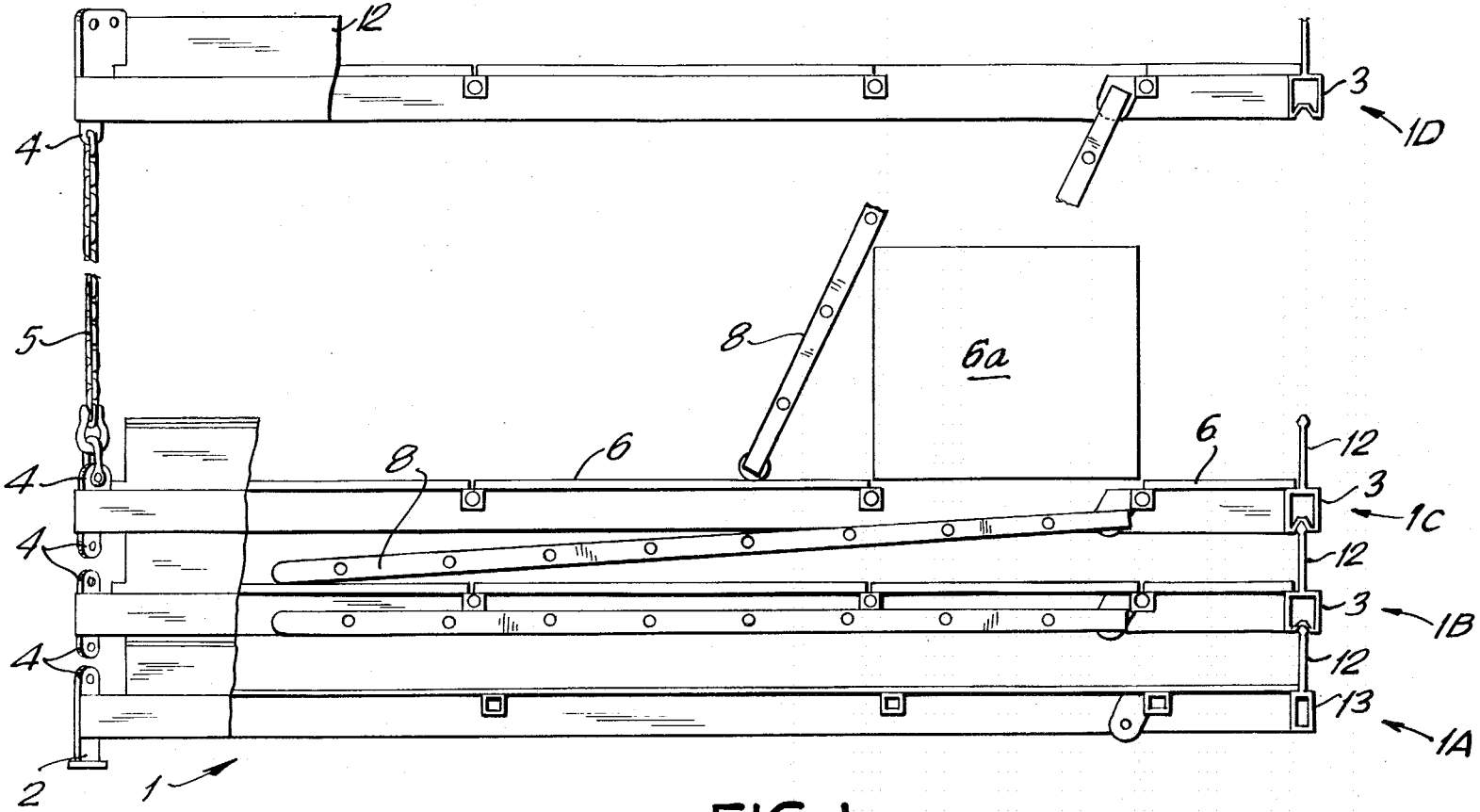
FIG. 1 is a schematic side view of partly collapsed scaffolding in accordance with the invention.
Figure 2B:
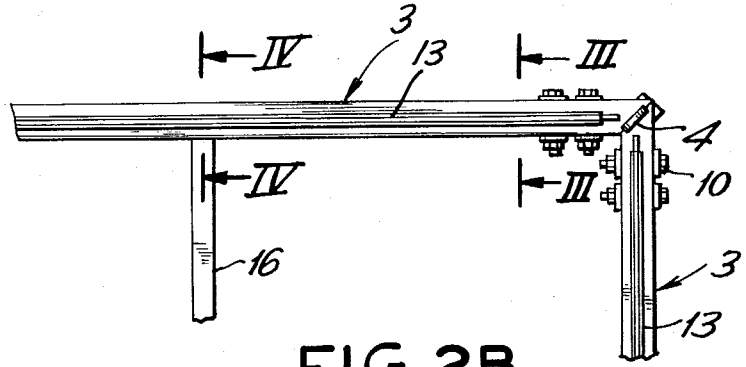
FIGS. 2A to 2D are plan view fragments of the FIG. 1 embodiment.
Figure 2C:
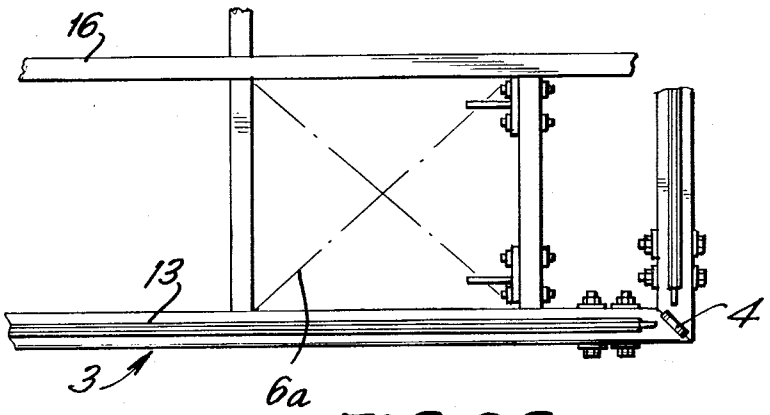
Figure 2A:
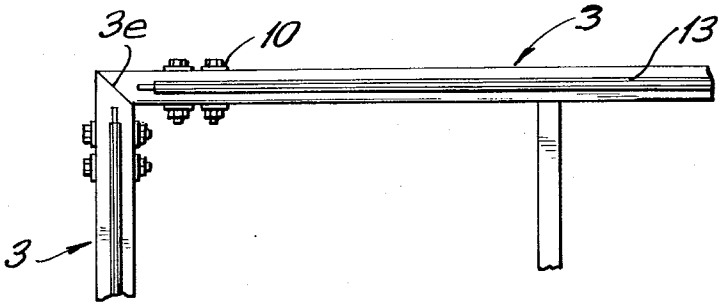
Figure 2D:
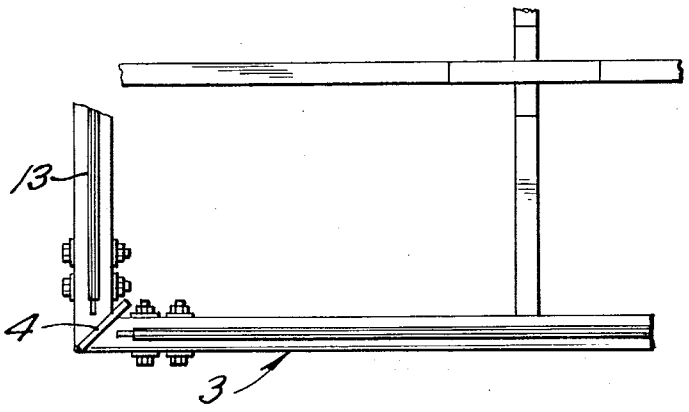

Referring to FIGS. 1 to 5, and in particular to FIG. 1, scaffolding includes a number of superposed platforms 1A to 1D. Each platform includes a framework having an outer frame member 3 provided at each corner with a suspension plate 4 to enable the platform to be linked to that immediately above and/or below it by chains 5. Opposite sides of the outer frame members are interconnected by cross pieces 16 which together with the outer frame member 3, support a deck plate 6 including a trap door **6*a***.

The platforms 1A, 1B and 1C are illustrated resting one upon another in a collapsed stack, and the platform 1D as having been raised by means of a winch into an extended operational position. Continued operation of the winch will raise all of the remaining platforms, other than the lowest.

As each raiseable platform is raised, a ladder 8 pivoted to its underside rotates into an almost upright position.

Figure 3:
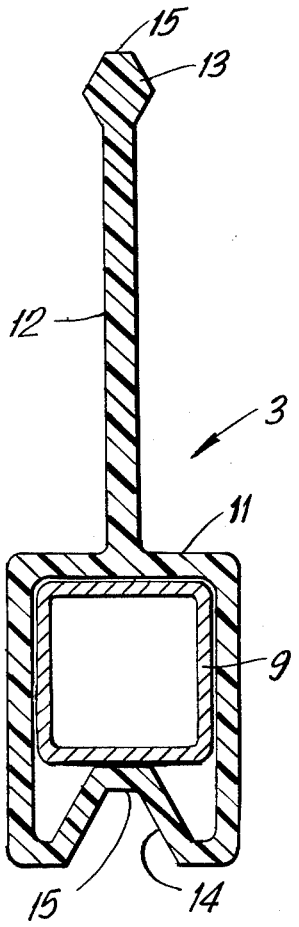
FIG. 3 is a section on line III—III in FIG. 2B through an outer frame member fabricated from glass reinforced plastic (GRP).
Figure 8:
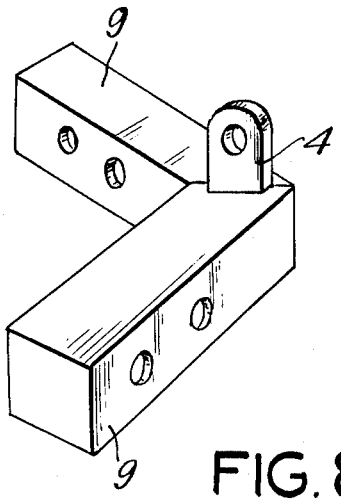
FIG. 8 shows a corner fitment, of the FIG. 1 embodiment.
Figure 9:
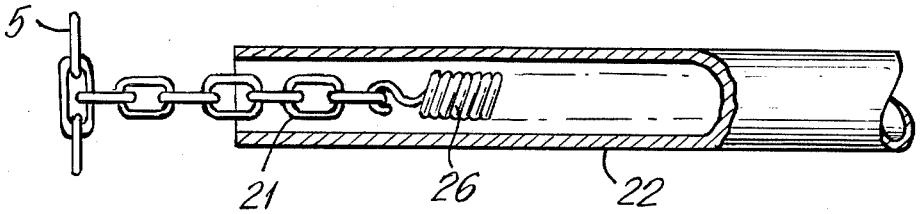
FIG. 9 shows a guard rail.

The outer frame member 3 of each of the platforms, 1A, 1B, 1C and 1D includes four hollow sections 11 extruded or otherwise formed from glass reinforced plastic. The ends of the sections 11 are cut at 45° as shown at **3*e* in FIG. 2A, and receive the steel corner fitments 9 as shown in FIGS. 3 and 8. Each fitment includes two arms 9 at right angles to each other which are inserted into the meeting ends of the hollow sections 11 and secured by bolts 10. The fitment of the lowest platform 1A is provided with a foot 2 and suspension plate 4. The fitment intermediate platforms 1B and 1C has two suspension plates 4, one of which extends up and the other down. The fitment of the uppermost platform 1D has a suspension plate 4** on its underside and a bracket on its upper side for attachment to rigid superstructure of the top platform.

Figure 4:
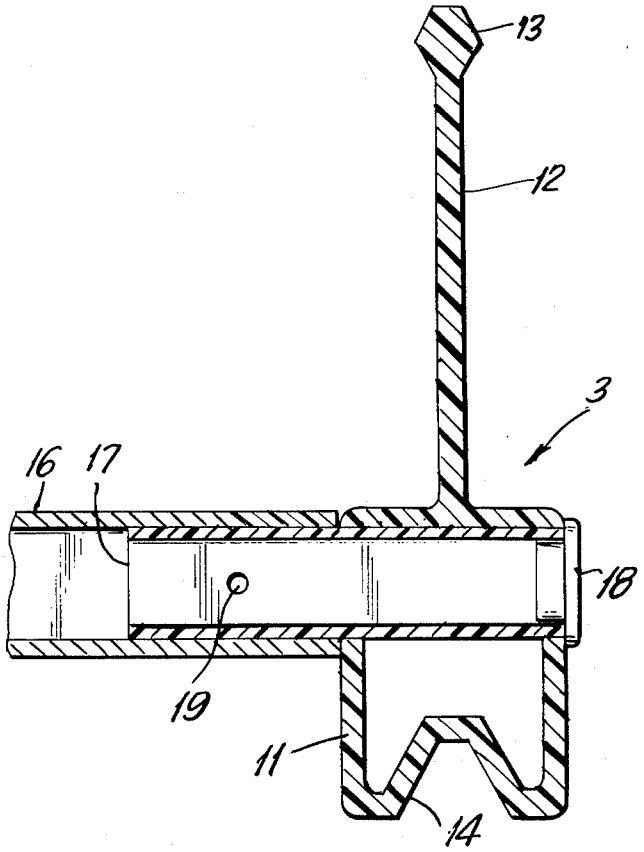
FIG. 4 is a section on line IV—IV in FIG. 2B through the outer frame member.
Figure 5:
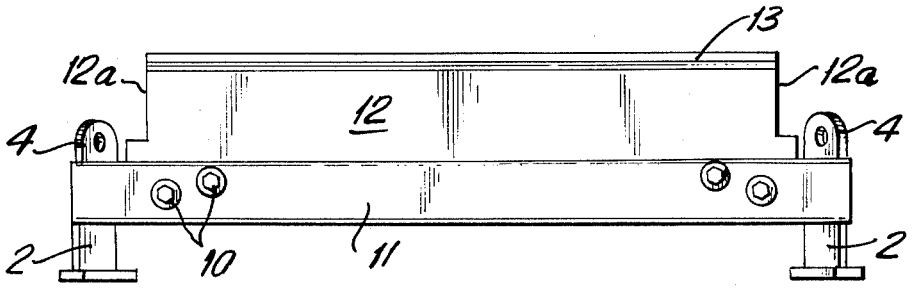
FIG. 5 is an end view of a platform of the FIG. 1 embodiment showing the kick plate 12.

The steel fitment 9, 4 ensures a structurally sound joint at each of the corners which corners are vulnerable to damage when the scaffolding is in use. The outer frame member 3, as shown in FIGS. 3 and 4, has a hollow box beam portion 11 and an upwardly projecting kick plate 12. The beam 11 and plate 12 are molded as an integral unit. The upper end of the kick plate 12 is a longitudinal thickened rib 13.

The lower wall of the beam portion 22 is shaped to have a longitudinal channel 14, the sides of which are complementary to the rib 13. The channel 14 tapers towards the top at a total included angle of 60° to facilitate mating of the rib 13 and the channel 14 of adjacent platforms. The channel 14 and rib 13 are flattened at 15 for safety and to reduce stresses applied during mating of rib 13 and channel 14.

The plate 12 serves as a toe-or-kick-plate of the assembled platform.

The cross pieces 16 of the support frame serve with the outer frame member 3 to support the deck and are joined to the outer frame member by glass reinforced plastic tubes 17 inserted into their ends and passing through apertures in the outer frame member. The outer ends of the tubes 17 being closed by PVC caps 18. The tubes are made fast with the cross pieces by pins 19.

Figure 6:
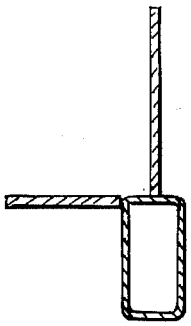
FIG. 6 is a section through an outer ram member fabricated from steel, for a bottom platform.
Figure 7:
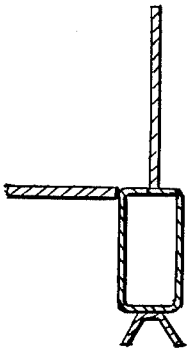
FIG. 7 is a section through an outer frame member fabricated from steel, for a platform other than a bottom platform.

In an alternative embodiment outer frame member 3 may be fabricated from separate interwelded steel components as shown in FIG. 6 for the lowest platform and FIG. 7 for the intermediate platforms.

The ends 12*a* of each of the kick-plates 12 terminate at short of the ends of the hollow sections 11 so as to provide space for chains to be connected to the suspension plates and also to permit the chains to fall into the platform space between the plates 12.

Stowing of the chains in this way is facilitated by a tension spring 26 connecting two horizontal lengths of chain 21 extending between each pair of vertical chains 5 and within a tubular guard rail 22. The spring 26 arrangement is positioned along the vertical chains by the requisite distance needed to enable the spring 26 to kink the vertical chains 5 as they slacken and in consequence fall within the space defined within the kick-plates 12 for neat and unobstructive stowage.

The spring containing guard rail 22 may be the topmost or the middle one of three guard rails associated with each platform.

I claim:

1. In a collapsible scaffolding comprising a number of platforms and flexible suspension means for suspending the platforms in vertical array, an outer support frame member for at least one platform comprising a box beam portion, a toe-plate portion surmounting the box beam portion; the underside of the box beam portion having therein a channel for receiving the upper edge of the toe-plate portion of the next lower platform.

2. An outer support frame as claimed in claim 1, wherein the toe-plate portion is surmounted by a profiled rib.

3. An outer support frame as claimed in claim 1, wherein there is a gap at each end of the toe-plate portion relative to the end of the box beam portion.

4. An outer support frame as claimed in claim 1 fabricated in one piece from GRP.

5. In a collapsible scaffolding comprising a number of platforms and flexible suspension means for suspending the platforms in vertical array, each platform being bounded by a toe-plate, means for causing the suspension means to fall within the space internal of the toe-plate, said means comprising a tensioning device extending between pairs of suspension means, and passing through a hollow guard rail, the distance between each end of the guard rail and the fully tensioned suspension means being such that the suspension means is caused to kink as it slackens and fall within the space internal of the toe-plate.

* * * * *